United States Patent [19]

Grunberger

[11] 4,088,252

[45] May 9, 1978

[54] SCHOOL BOOK BACK SATCHEL

[76] Inventor: Arno Grunberger, Neubaugasse 4/13, 1070 Vienna, Austria

[21] Appl. No.: 665,483

[22] Filed: Mar. 10, 1976

[30] Foreign Application Priority Data

Mar. 19, 1975 Austria ..... 2131/75

[51] Int. Cl.[2] ..... A45F 3/00

[52] U.S. Cl. ..... 224/8 R; 150/1.6; 190/41 R; 224/25 A; 224/47

[58] Field of Search ..... 224/5 N, 5 Q, 5 W, 6, 224/8 R, 9, 11, 12, 25 A, 26 R, 8 A, 10, 45 N, 45 P, 46 R, 47; D87/1 R, 1 A; 190/41 R, 53, 54, 60, 61, 44; 150/1.6; 220/320; 285/407

[56] References Cited

U.S. PATENT DOCUMENTS

| | | | |
|---|---|---|---|
| 201,537 | 3/1878 | Lambert | 224/8 R |
| 518,270 | 4/1894 | Orth | 224/8 R |
| 922,046 | 5/1909 | Royce | 224/9 |
| 1,886,421 | 11/1932 | Perkins | 285/407 |
| 2,162,057 | 6/1939 | Brandt et al. | 224/5 W X |
| 2,404,777 | 7/1946 | Gaines | 220/320 |
| 2,875,868 | 3/1959 | Powell | 190/44 |
| 3,017,567 | 1/1962 | Barringer | 224/11 X |
| 3,273,770 | 9/1966 | Miller | 224/46 R |
| 3,295,733 | 1/1967 | Heal | 224/45 N |
| 3,693,849 | 9/1972 | Knabenbauer | 224/25 A X |
| 3,938,718 | 2/1976 | Madison | D87/1 A X |
| 3,957,183 | 5/1976 | Gadberry | 224/25 A X |
| 3,960,300 | 1/1976 | Dickler | 224/8 R |

FOREIGN PATENT DOCUMENTS

| | | | |
|---|---|---|---|
| 221,944 | 11/1961 | Austria | 224/26 R |
| 276,083 | 7/1914 | Germany | 224/8 R |
| 693,272 | 7/1940 | Germany | 224/8 R |
| 81,543 | 3/1953 | Norway | 150/1.6 |
| 203,706 | 2/1965 | Sweden | 224/5 W |
| 857,965 | 1/1961 | United Kingdom | 224/8 R |

*Primary Examiner*—Trygve M. Blix
*Assistant Examiner*—Winston H. Douglas
*Attorney, Agent, or Firm*—Sughrue, Rothwell, Mion, Zinn and Macpeak

[57] ABSTRACT

A school book back satchel includes a rigid back piece, a rigid lower piece which, when secured to the back piece, defines a bag supporting pocket, and a rigid upper lid piece. The back piece has a lumbar groove widened at its lower end, a transverse ventilation groove, an outwardly contoured lower portion, strap accommodating slots, and a disappearing handle. A waterproof accordion bag is snapped, riveted or glued onto the back piece, and may be provided with closure straps, a channel to receive the ends of the shoulder straps, or external flap pockets. The satchel volume may be increased by inserting a rigid expansion ring, and the parts may be held together by a channeled rubber band to facilitate component changes.

8 Claims, 12 Drawing Figures

SCHOOL BOOK BACK SATCHEL

BACKGROUND OF THE INVENTION (1) Field of the Invention

The present invention relates to a school satchel produced from several parts made of variable raw materials, the back wall of which is made of plastic and preferably is curved concavely in a transverse direction, fitting the body.

(2) Description of the Prior Art.

Most known school satchels, obtainable on the market and designed to rest on the back of the person carrying it, are relatively soft, whereby the amorphous, soft part of the back wall, which is not capable of elastically retaining any shape imparted to it, is anatomically unfavorable and is accompanied by puntiform pressure spots, so that these satchels are uncomfortable when carried on the back.

Mostly, the known school satchels consist of leather or material similar to leather, such as a soft plastic or synthetic leather. Apart from an indisputably low wear factor, and beside its softness, leather has the disadvantage of absorbing moisture relatively well and to be pervious to water, so that the contents of the school satchel in case of bad weather (snow or rain) are not protected absolutely against the action of moisture and, upon staying in said school satchel for a prolonged period of time, will infallibly be damaged. This hygroscopic characteristic of the leather makes cleaning problematical too. Furthermore, leather is very difficult to dye and also not very colorfast, and it also has a fairly high weight of its own.

From the German AS No. 1,297,292, furthermore, a school satchel has been known, which consists of a plastic container, formed in one piece, with a hinged cover attached to the container and consisting of leather or some similar raw material. At the same time the back wall of the container is adapted to the shape of the body so that carrying of this school satchel is made more easy.

The disadvantage in case of these known school satchels as well as in case of the above described, traditional school satchels especially is, that any true rationalization during finishing or pre-finishing is hardly possible. Rather a whole series of additional operations will be necessary during manufacture, which will have to be done mainly be skilled workers and by hand.

Furthermore, the known school satchels are relatively heavy because of the material used. As an example, the average weight of known school satchels amounts to 1 kg to about 1.20 kg, in extreme cases even 1.70 kg. That, measured by the weight of the books and teaching aids of a fourth grader, which amount to about 3.5 kg, already constitutes about half the weight of the articles to be carried. Beyond that, the known school satchels are also too large and cumbersome, i.e., the dimension of the school satchels do not correspond either to the body measurements of a child nor to the shape of the teaching aids carried. These reasons lead to the fact, that the school satchel always acts as a foreign body and is always felt to be tiresome and unpleasant.

Another disadvantage of the known school satchels is the fact that the cover is always placed over the feed opening from behind to the front, i.e., whenever the school satchel hangs or stands, always two manipulations are needed: the cover must be pulled up with one hand and must be held during the entire charging or removal process, while the other hand does the filling or removing. That means that the content of the school satchel cannot be inspected at just any time and only with a special effort. Moreover, in the case of empty or nearly empty school satchels the closing arrangement is often insufficient, since an escape of the satchel, whenever the cover is pressed against it, is unavoidable. In addition, generally simple metal spring locks are used for closing the school satchels, which are attached to the edge of the cover and the front of the school satchel. As a result of the inflexibility in direction of pull of the cover and of the front wall, and as a result of the type of construction of the closing arrangment, in most cases no possibility of adaptation of the volume of the satchel to the content is possible. If, in the extreme case, the satchel is empty or almost empty, i.e., if it has been charged with few contents, then the closing of the cover can be accomplished only with great difficulty because of a lacking counter pressure.

SUMMARY OF THE INVENTION

It is object of this invention to create a school satchel, which is agreeable to carry, easy to open or to close, can be adapted easily and simply to the pertinent requirements of volume and has many uses. Furthermore, the satchel is to have as good as possible stability, it should be stable, weather resistant, color fast and wear resistant, and it should be simply and cheaply producible.

The school satchel of the invention is characterized in that an at least essentially form stable plastic shell is provided as the rear wall, on the side of which, facing away from the back of the carrying person, at least one bag member, consisting of a soft material, such as perlon fabric, has been attached, for instance by means of press buttons, by means of a button-slit hinging connection or by means of the carrying straps of the satchel. A school satchel is thus obtained which is easy and comfortably to carry, which can be produced simply and cheaply, and which is easily handled, whereby however, the content of the satchel is already safely protected by the plastic shell.

The plastic shell has a central recess, indentation etc., running perpendicularly across its entire height. As a result, the contact pressure will be removed from the spine, i.e., unpleasant pressure points are avoided, and a goode vertical ventilation will be achieved.

Experiments have shown that whenever, due to an increasing load, the surroundings of the lumbar portion of the spine are drawn-in ever more, i.e., disproportionately strongly, for absorption of the pressure, this will cause an agglutination of the contact pressure in this area. In order to free the spinal column as much as possible from any direct load (contact) it will be advantageous furthermore, if the indentation, groove etc., in the lower area of the plastic shell, preferably in the lower third, is broadened.

The plastic shell is curved two dimensionally, i.e., it bends in its lower area at the beginning of the lumbar portion of the spine, in the direction away from the back of the carrying person.

In order to avoid sweating in the summer at direct contact areas with the plastic shell, it has a cross groove, indentation etc., running over its entire width.

The plastic shell also has slits for the attachment of two separate carrying straps somewhat below its upper edge as well as in the lower area. At the same time, it should be mentioned here that in case of known school satchels it is a great disadvantage that generally only a single carrying strap is provided, which is attached directly in the center at the upper edge of the satchel, which often causes a dropping down of the satchel when carried on the back to below the shoulder blades, thus away from the optimum pressure absorption areas, and causes an extreme load to the lumbar spinal column. Add to this, that the lower strap suspension has been shifted mostly laterally to the extreme edge of the satchel or has even been arranged on the bottom, which in case of running naturally causes an abnormal lateral motion and often even danger of injury. Moreover, additional fixtures and operations are needed for the attachment of these carrying straps on the known satchels, as a result of which production will be more expensive. In the satchel of the invention a simple attachment of the carrying straps is now possible, whereby a good, high, anatomically correct fit of the satchel will be achieved in a simple way. The slits in the plastic shell at the same time also make possible a simple adjustment of the carrier straps, so that they can be adapted to the size of the child. The carrying straps can be colored perlong belts up to 3.5 cm wide, which do not cut in and which moreover are distinguised by low weight and extemely high loading capacity. The slits at the lower edge of the satchel are attached effectively at a distance from the perpendicular outside edges, in order to prevent a lateral movement of the satchel during running. Here too, the carrier straps are laterally adjustable, in order to do justice to the body of the carrier.

Guides are provided on the plastic shell on the side away from the body of the individual in the upper areas of the corners, through which the carrying straps put through the upper slits are guided, whereby the carrying straps are attached furthermore to the satchel outside of the side away from the plastic shell, so that upon slinging the satchel, the pocket is closed automatically by stretching the carrying straps.

The actual pockets can be suspended or fastened by means of strong press buttons, located on the plastic shell. Each pocket may by itself still have a carrying handle, so that it can be moved easily, independently of the plastic shell, within the class room or the home. Loading can take place while standing and also while hanging, laterally on the school bench, exclusively from above the contents can always be inspected and surveyed. Articles in the school satchel can be removed without difficulty with only one hand. The contents can be exchanged and varied as often as desired as a result of the proper dimensioning of the actual pockets and of the plastic shell.

In order to protect the contents of the pockets from moisture, dirt etc., a watertight covering, particularly one consisting of rubber material, can be provided for the satchel.

A cover flap is provided as a covering, disposed on top on the side facing away from the plastic shell, which can be fastened by means of a spring lock provided on top on the plastic shell.

The plastic shell is provided laterally or on its upper side with slits into which elastic straps for closing the satchel can be introduced, which straps are attached on the wall of the satchel or on the rubber covering, facing away from the plastic shell.

In order to protect the actual pockets even better against moisture and dirt, a laterally pulled-up, formstable plastic molded part for the bottom is provided below on the side of the plastic shell facing away from the back of the carrier. This part, which can be molded in one piece with the plastic shell or be attached releasably to said shell, makes possible also a setting down of the satchel, and for this it will be effective if foot elements are attached laterally on the underside of the molded part for the bottom. The molded part for the bottom may also be provided on its underside with reinforcing ribs.

A covering up molded element is provided in the upper area of the plastic shell, which shields the pocket, and which consists of an upper shielding wall with lateral projections. This covering molded element can be molded releasably with the plastic shell or else in one piece with it.

The bottom molded part and/or the covering molded part is attached to the plastic shell by means of a rubber ring with U-shaped cross section, and encircling flanges are provided on said molded parts as well as on the plastic shell. This rubber ring also acts as some sort of a rubber bumper, which beside its function as a connecting element between bottom molded part, covering molded part and plastic shell, also represents an effective protection against collision.

In order to simplify production the bottom molded part and the covering molded part may be combined to one unit by lateral connecting strips.

The bottom molded part and/or the covering molded part, possibly with the interposition of a gasket, may be attached to the plastic shell by means of press buttons.

An intermediate ring-molded part of constant width is provided for the sake of increasing the volume between the plastic shell and the bottom molded part and/or the covering molded part.

A perlon fabric, which excells in tear resistance and in absolute water tightness is particularly advantageous for the exchangeable pockets. In addition it has a very low specific weight and can also be obtained in luminous colors, which contributes to the safety of school children as bearers of the satchel.

The closed satchel, attached to the plastic shell, can completely disappear in the housing formed by the plastic shell, or the covering can be pressed on in such a way that any penetration by water or moisture is made impossible. At the upper end of the plastic shell a plastic handle is attached in the middle, into which a rubber part is inserted in order to avoid any cutting-in of the edges of the handle during carrying. The handle can be insertible into the satchel, in order not to be in the way when not in use.

DESCRIPTION OF THE PREFERRED EMBODIMENTS

Figure 1:
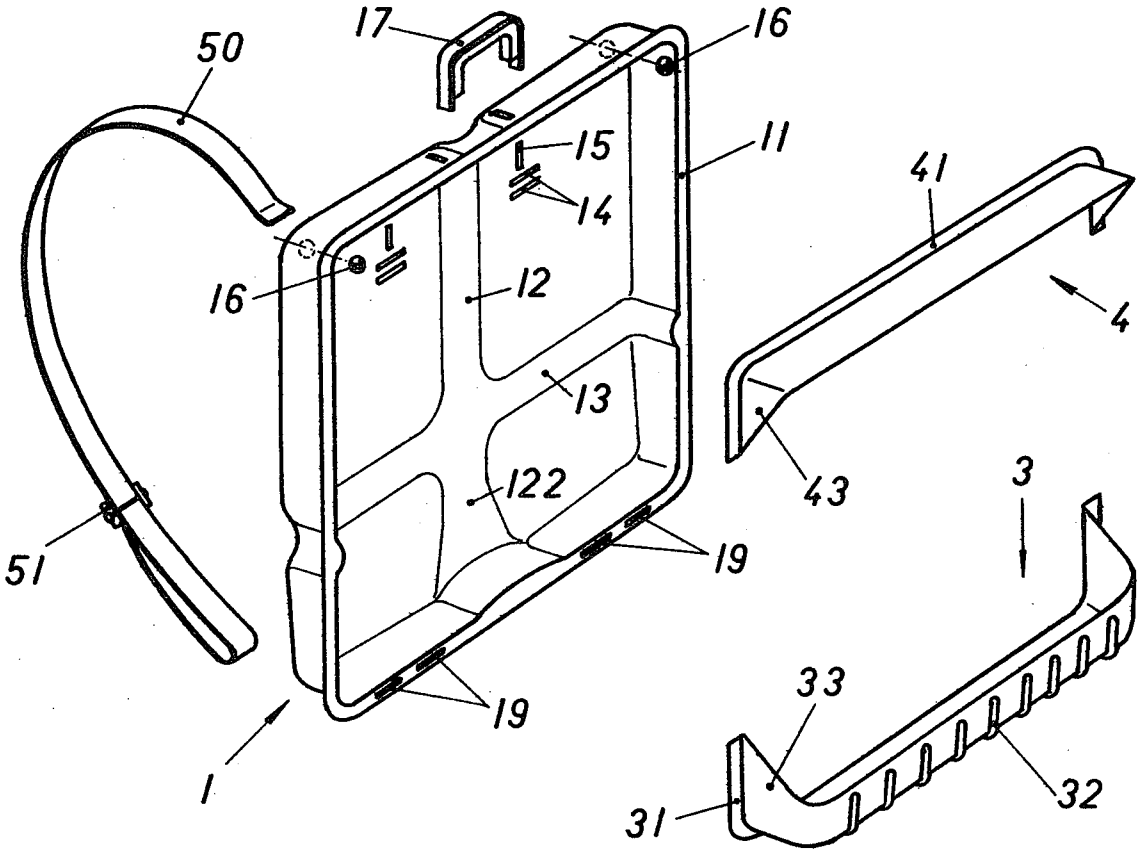
FIG. 1 shows an exploded view of a plastic shell (with carrying handle and shoulder straps) and the various molded parts of the school satchel of the invention.

FIG. 1 shows a plastic shell 1, a bottom molded part 3 and a covering molded part 4. At the same time, the molded parts 3 and 4 can be combined with the plastic shell 1, according to wish. This plastic shell 1, on its side facing away from the back of the carrying person has a peripheral flange 11, and similar flanges 31 or 41 are provided on the molded parts 3 and 4. These flanges serve for the connection of the corresponding parts.

The plastic shell 1 has an indentation or groove 12 which runs vertically whenever the satchel is on the back and which in its lower area, preferably in its lower third, has been widened as indicated at 122. Furthermore, a transverse ventilation groove 13 has been provided. The plastic shell 1 is bent in its lower area, starting from the vertical plane i.e., from the back of the carrier, as can best be seen from FIG. 4. The purpose of his is to relieve the spine especially in the area of the lumbar vertebrae, so that the load can be absorbed essentially by the shoulder muscles.

In order to be able to attach the shoulder straps 50 (Fig. 1 shows only one such shoulder strap) to the plastic shell 1, horizontal slits 14 and perpendicular slits 15 have been provided in the upper marginal area through which the end of the shoulder strap 50 is pulled and can be anchored inside of the plastic shell 1 facing away from the carrying person. The shoulder strap 50 is continuously adjustable in its length by means of a customary slide arrangement 51, and the resulting loop is pulled through slits 19 in the marginal area of the plastic shell 1 for the purpose of attaching the strap in said lower marginal area. For a lateral adjustment of the straps, either several slits 19 can be provided side by side, as shown in FIG. 1, or else an elongated slit can be made, whereby the friction between the relatively broad shoulder strap and the plastic shell 1 will be sufficient to prevent the strap from slipping too easily.

Figure 4:
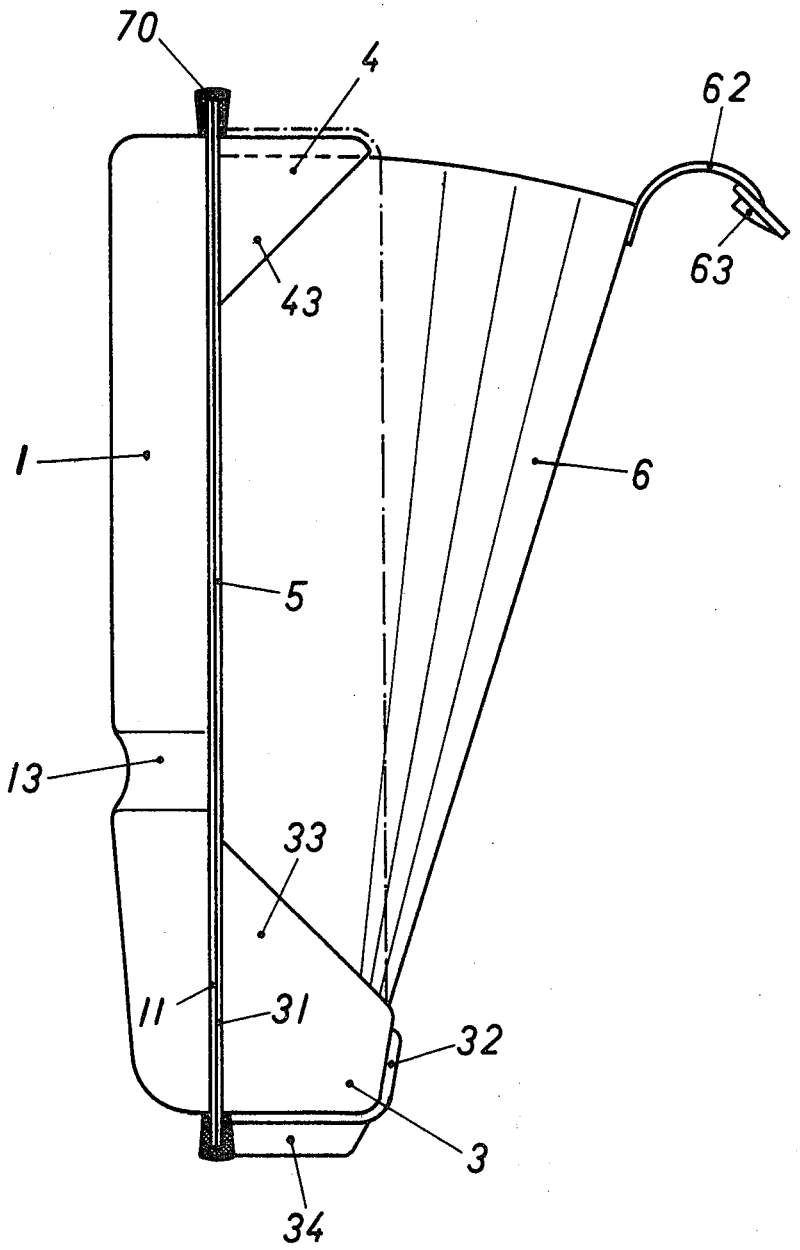
FIG. 4 is a side view of the school satchel with bottom molded part and covering molded part as well as inserted pocket, attached to the plastic shell.
Figure 5:
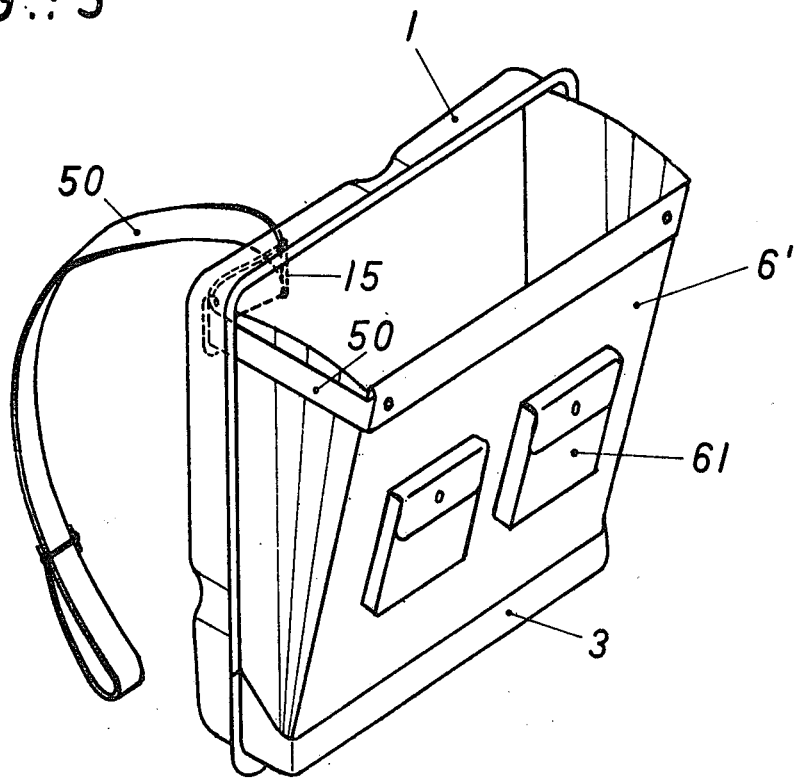
FIG. 5 is a perspective view of the school satchel.
Figure 6:
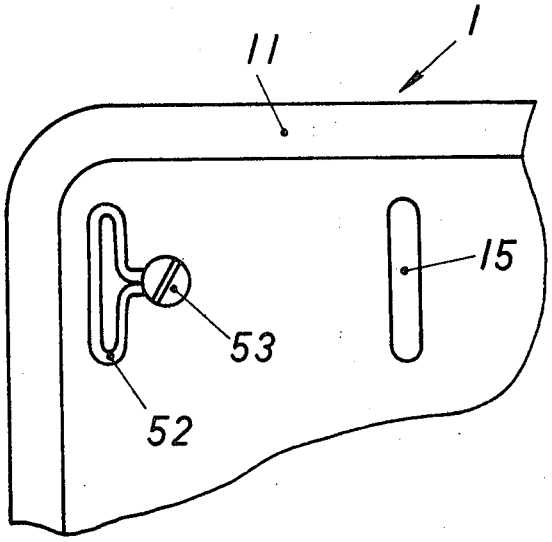
FIG. 6 shows a detail of the plastic shell of the school satchel according to FIG. 5.

In order to be able to attach a bag 6 or 6′ (FIGS. 4 and 5) to the plastic shell 1, press buttons 16 (FIG. 1) are provided for example on the inside of the plastic shell 1, which collaborate with corresponding pushers (not shown) on the bag 6. As is illustrated in FIGS. 5 and 6, the shoulder strap 50 itself can e engaged directly for the attachment of the bag 6 or 6′. For this purpose, the shoulder strap 50 is guided through the vertical slit 15 as well as through a guide 52 riveted on at 53 to the plastic shell 1, and connected with the latter on the outside of the bag 6′. The bag 6′ can, in addition , have lateral pockets 61 on the outside which can e closed by means of press buttons or else by means of a zipper (not shown).

On the top side of the plastic shell 1 perforations or apertures have been provided through which a handle 17 is pushed with its two ends. This handle 17 can be pushed in or pulled out to a certain extent, and it moreover has a rubber cushion, so that it makes easy carrying possible.

The bottom molded part 3 has been pulled up laterally, as in FIGS. 1 and at 4 at 33, and on its underside and front it has reinforcing ribs 32. As has further been shown in FIG. 4, feet 34 can be provided on the underside of the molded bottom part, which are either molded with the bottom part 3 or glued on to its underside. In the latter case the feet 34 consist of some rubber or rubber-like material.

Figure 2:
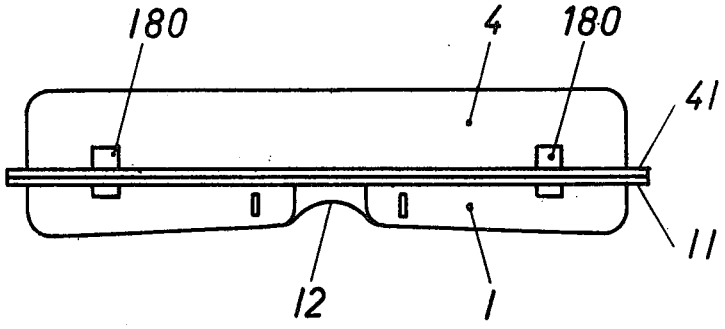
FIG. 2 is a top view of the satchel of the invention, showing a molded cover part is attached to the plastic shell.
Figure 3:
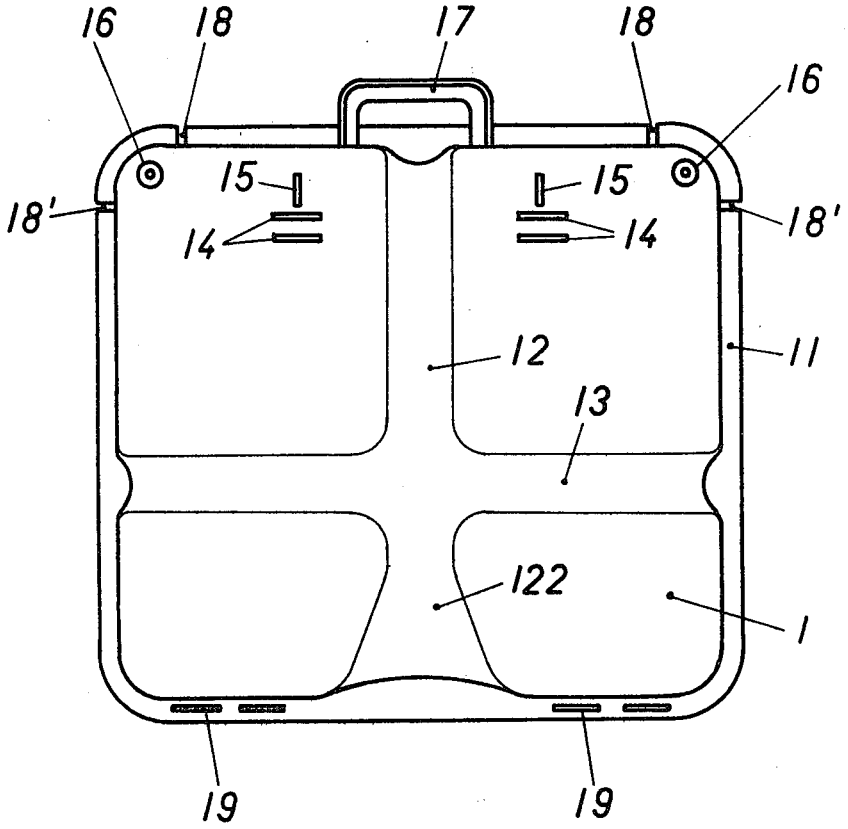
FIG. 3 is a view of the plastic shell of the satchel.
Figure 11:
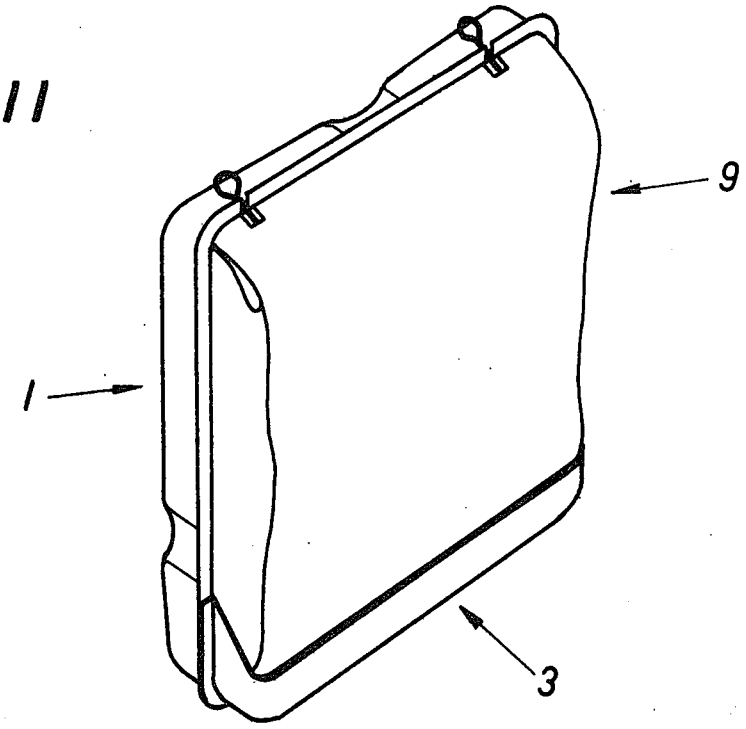
FIG. 11 shows a perspective view of the invention, which a satchel covering made of rubber has been provided.

The molded covering part 4 consists of a shielding wall with lateral projections 43 and a flange 41. This molded covering part 4 constitutes an additional protection for pockets attached to the plastic shell 1, even though these pockest, as has been illustrated in FIG. 4, can have a covering flap 62 which is watertight and can be locked by means of a latch 63 with a spring lock 180 (FIG. 2) attached on the back part 1. Slits 18 or 18′ can also be provided in the flange 11 for the attachment and locking of the pocket 6 or 6′ or for the closing of a rubber covering 9 as illustrated in FIG. 11, in which straps equipped with a ring or a button at their ends can be hooked in which are attached to the pocket or to the covering 9. These straps can also consist of a string or an elastic material.

Figure 8:
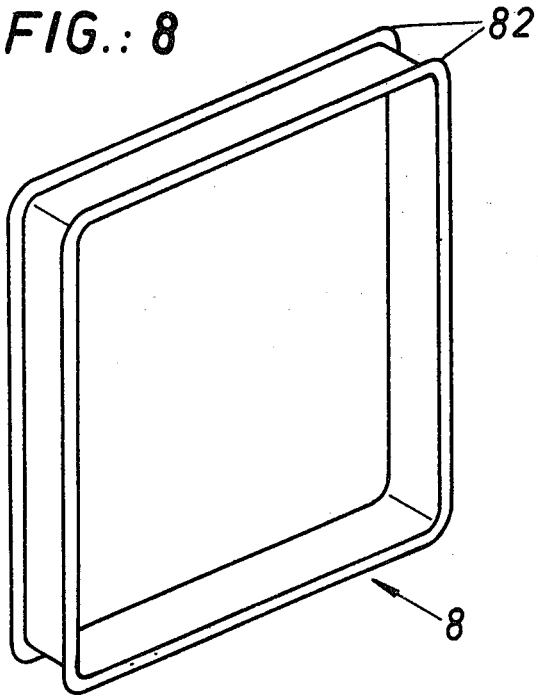
FIG. 8 shows a perspective view of an intermediate ring, which may be provided in order to increase the volume.
Figure 9:
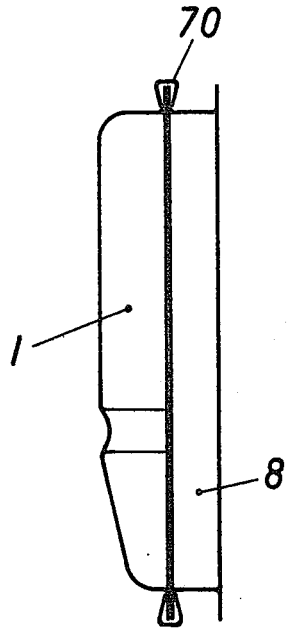
FIG. 9 shows a plastic shell with intermediate ring attached thereto.

In regard to the various possible combinatons of the school satchel, as shown in FIG. 5, only a molded bottom part 3 can be attached to the plastic shell 1 and one corresponding pocket 6 or 6′ can be provided. On the other hand, as FIG. 4 illustrates, for shielding of the pocket 6 a molded covering part 4 can also be provided. As FIGS. 8 and 9 show, an intermediate ring 8 can also be provided for the enlargement of the volume of the school satchel. This intermediate ring 8 has corresponding peripheral flanges 82 and can be disposed on the plastic shell 1 between said shell and the molded bottom and covering parts.

A rubber ring 70 with a U-shaped cross section serves for the connection of the individual molded parts, and encircles the flanges of th parts and holds them together. This ring 70 can also be glued on, whereby one rigid unit is obtained. The individual molded parts can also be interconnected by press buttons provided on the flanges, and a peripheral sealing ring can be arranged over or between the flanges in order to make the container as watertight as possible.

Figure 7:
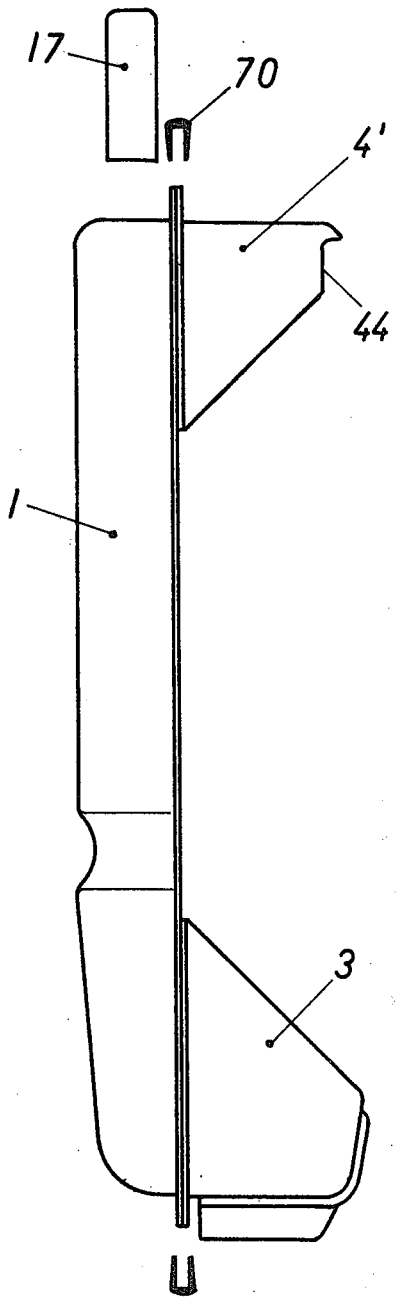
FIG. 7 is a side view of a plastic shell with bottom molded part attached thereto and covering molded part according to a modified embodiment, which is particularly suited for the attachment of the shoulder straps according to FIG. 5.

In the embodiment shown in FIG. 7, a molded bottom part 3 and a molded covering part 4′ are attached to the plastic shell 1. The rubber ring 70 serving as a connection, as well as the handle 17, have only been shown schematically in an exploded manner. This embodiment differs from that of FIG. 4 in that a flattening 44 is provided at the front of the molded cover part 4′. This is particularly effective whenever a pocket 6′ is used, as shown in FIG. 5, since then the shoulder strap 50 guided through the slit 15, the guide 52, and the upper edge of the pocket can fit against this flattening 44.

Figure 10A:
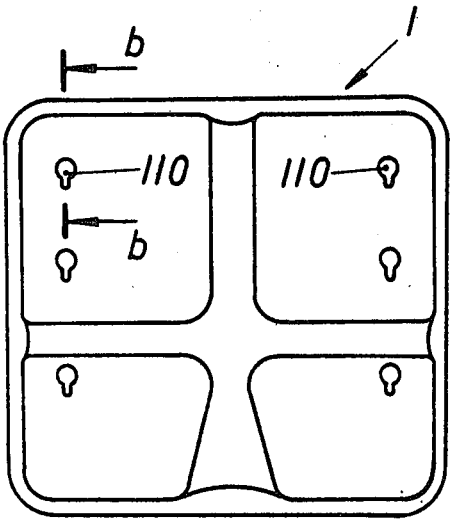
FIGS. 10*a* and 10*b* (taken along lines *b—b* in FIG. 10*a*) illustrate how a bag can be hung by slits in the plastic shell.
Figure 10B:
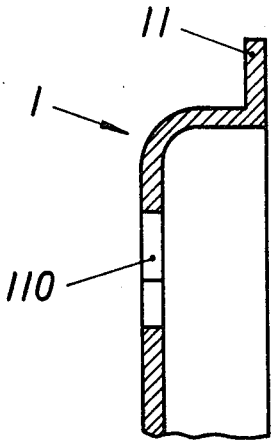

In regard to fastening the pockets 6 or 6′, these pockets can have buttons which can be hooked into slits 110 (FIGS. 10*a* and 10*b*). It is also possible to provide several such slits 110 on top of one another, whereby it is possible to hook in pockets of different size and height at different levels or else to provide two or more pockets one above the other at the same time.

The satchel of the inventon is relatively simple to produce, since the platstic shell or the molded parts can be produced in a deep drawing process or by injection molding. The sholder straps 50 and the pocket 6 consist preferably of a perlon fabric. The contact with the back, i.e., the surface for the carried load, can e substantially congruent with the anatomy of the back. The plastic shell is generally rigid, but within a certain scope it can be made elastic and resilient. The width of the shoulder straps is preferably 2 to 3.5 cm so that any cutting-in or twisting of the straps when the satchel is carried will be avoided.

As a result of the assembly of prefabricated parts with regard to the pockets that are to be used, and of molded parts to be attached to the plastic shell, one can achieve a change of volume in a simple manner. For example, corresponding to the individual school days, a different pocket with a different capacity can be used. The individual parts of the satchel can be produced in corresponding luminous colors to enhance the safety in traffic of the school children independently of the weather, radiation angle of search lights, etc. Self-reflecting materials or coatings can be used for the pockets or coverings.

Instead of the slits 110 shown in FIGS. 10*a* and 10*b*, which penetrate the entire wall of the plastic shell 1, rails with undercut grooves can also be glued on to the inside of the plastic shell1, whereby the pockets can be hooked into these grooves, the openings of which can be formed similarly to those of the slits 110. Furthermore, the molded covering part 4 and 4' and the molded bottom part 3 can be interconnected into a unit by lateral connecting strips 5, as seen from FIG. 4. The pocket 6 or 6' can also be permanently attached on the inside of the molded part of the rear wall of the plastic shell 1 by rivetting, gluing, etc.

What is claimed is:

1. A school book back carried satchel comprising:

a substantially light weight plastic back wall shell including integral sidewalls extending continuously about the periphery of the back wall and defining with the back wall a rectangular bag back pocket facing outwardly on one side of said back wall, said shell being curved concavely in a transverse direction on the other side of said shell back wall, opposite said pocket, to fit the body of the user, at least one bag member of a soft pliable light weight material, and means for mounting said at least one bag member to said one side and partially within said bag back pocket to protect said soft, pliable light weight material bag and its contents about the edges of said bag, said plastic shell further comprising a vertical, central groove extending over the entire vertical height of the plastic shell on the other side of the back wall to accomodate the full lumbar contour of the user and to define a vertical ventilation path between the user and the shell extending the full vertical height of said shell, and a groove extending transversely over the entire width of said plastic shell and intersecting said vertical, central groove to affect transverse ventilation air flow between the back of the user and said plastic shell, and wherein said shell sidewalls terminate in flanged edges and said satchel further comprises a rigid molded plastic bottom member having complementary flange edges to that of said shell and being fixedly coupled to said shell at the lower end thereof on the side facing away from the back of the user by way of said complementary flanges, and wherein said rigid molded plastic bottom member includes laterally spaced, upwardly extending side projecton portions to define with said shell sidewalls an enlarged bottom pocket acting in conjunction with the back pocket of said shell for receiving and further protecting the bag member and its contents.

2. A school book back carried satchel as claimed in claim 1, wherein slits are provided within said plastic shell on both sides thereof adjacent the upper edge and in a lower area adjacent the bottom of said shell, two separate shoulder straps are attached to said plastic shell at said lower area slit and extend respectively, through the slits adjacent the upper edge from the curved, concave other side of said shell, strap guides riveted on respective upper covers within said one side of said plastic shell defining said back pocket and the ends of the shoulder straps which extend through the upper slits pass through the guides and terminate in attachment to the bag member on the side of the bag member facing away from the plastic shell such that upon slinging of the satchel on the user's back, the bag member is automatically maintained closed by tensioning of the shoulder straps.

3. A school book back carried satchel as claimed in claim 1, further comprising slit recesses at lateral spaced positions within said plastic shell and on the upper side thereof for hooking elastic straps employed in closing said bag member.

4. A school book back carried satchel as claimed in claim 1, wherein said plastic bottom member is releasably attached to the plastic shell.

5. A school book back carried satchel as claimed in claim 1, further comprising laterally spaced foot elements mounted to the underside of the bottom member.

6. A school book back carried satchel as claimed in claim 1, wherein said plastic shell further comprises a rigid plastic covering part provided at the upper end of said plastic shell overlying the upper end of said bag member and consisting of a transverse upper shielding wall and laterally spaced, downwardly extending projections to each side thereof.

7. A school book back carried satchel as claimed in claim 6, wherein said plastic covering part is releasably attached to the plastic shell.

8. A school book back carried satchel as claimed in claim 6, wherein said plastic shell, said plastic bottom member and said plastic covering part are all respectively provided with peripheral flanges which engage each other in side to side relation, and wherein a rubber ring of U-shaped crosssection engages the side to side peripheral flanges of respective members to detachably attach the plastic bottom member and the plastic covering member to said plastic shell.

* * * * *